United States Patent [19]

Schuelke et al.

[11] Patent Number: 5,058,347

[45] Date of Patent: Oct. 22, 1991

[54] PANEL CONNECTOR SYSTEM

[75] Inventors: David J. Schuelke, Grand Rapids; James A. Looman, Holland, both of Mich.

[73] Assignee: Herman Miller, Inc., Zeeland, Mich.

[21] Appl. No.: 584,453

[22] Filed: Sep. 18, 1990

[51] Int. Cl.[5] ..... E04H 6/00

[52] U.S. Cl. ..... 52/339; 52/281; 52/127.11; 52/584; 160/135; 403/314; 403/DIG. 10

[58] Field of Search ..... 52/127.6, 127.7, 127.11, 52/239, 281, 584, 282, 36; 160/135, 351; 403/DIG. 10, 314

[56] References Cited

U.S. PATENT DOCUMENTS

| | | | |
|---|---|---|---|
| 2,766,855 | 10/1956 | Johnson et al. . | |
| 3,204,689 | 9/1965 | Howell . | |
| 3,312,025 | 4/1967 | Deakins . | |
| 3,327,440 | 6/1967 | Watkins . | |
| 3,517,467 | 6/1970 | Propst et al. . | |
| 3,593,475 | 7/1971 | LaGue . | |
| 3,744,826 | 7/1973 | Hawes . | |
| 3,809,142 | 5/1974 | Bleeker . | |
| 3,832,820 | 9/1974 | Eggert . | |
| 4,035,972 | 7/1977 | Timmons . | |
| 4,047,342 | 9/1977 | Boulva . | |
| 4,104,838 | 8/1978 | Hage et al. . | |
| 4,120,124 | 10/1978 | Temple . | |
| 4,126,978 | 11/1978 | Heller . | |
| 4,128,983 | 12/1978 | Matsubara . | |
| 4,232,183 | 11/1980 | Person . | |
| 4,375,010 | 2/1983 | Mollenkopf . | |
| 4,385,850 | 5/1983 | Bobath . | |
| 4,438,614 | 3/1984 | Raith et al. . | |
| 4,448,003 | 5/1984 | Hasbrouck . | |
| 4,567,698 | 2/1986 | Morrison | 52/239 X |
| 4,713,918 | 12/1987 | Cioffi . | |
| 4,716,698 | 1/1988 | Wilson et al. . | |
| 4,719,731 | 1/1988 | Ravotti et al. . | |
| 4,891,922 | 1/1990 | Hozer et al. . | |

OTHER PUBLICATIONS

French Patent Application No. 2,435,572, dated Aug. 8, 1979.

Herman Miller, Inc., Action Office Instruction document entitled "Variable Height Connector Installation" (publication date unknown).

*Primary Examiner*—David A. Scherbel

*Assistant Examiner*—Creighton Smith

*Attorney, Agent, or Firm*—Varnum, Riddering, Schmidt & Howlett

[57] ABSTRACT

A connector for an office partition panel which has a rectangular panel frame at the edges thereof and a wire management channel formed at an upper portion of the panel. The connector rigidly connects the rectangular panel frames together at the side edges and includes upper and lower wedge blocks on the panel edges and draw blocks adapted to grip the wedge block and draw the wedge blocks of adjacent frames together. A draw tube connects the draw blocks. A wire management channel is formed at an upper portion of the wedge blocks and at least one upper wedge block has a U-shaped configuration with a wedge surface formed at a bight portion of the U, the legs of the wedge block extend up along the upper sides of the panel and in registry with the wire management channel. A change-of-height connector which has a removable wedge block adapter can be mounted to the side of the panel frame for changing height without use of a spacer or corner. A draw tube can form a spacer or corner between adjacent panels. The draw tube is rectangular in cross-sectional configuration and can have cosmetic covers attached thereto. A filler extrusion can also be mounted to side portions of the draw tube between upper and lower wedge blocks to fill the space therebetween. A base connector comprises a base plate, a base cover and a post. The base plate is mounted to the lower portion of the draw tube, the post is mounted to the base plate and extends downwardly therefrom and the base cover is mounted to the base plate and to the post, extending downwardly from a lower portion of the draw tube.

50 Claims, 8 Drawing Sheets

PANEL CONNECTOR SYSTEM

BACKGROUND OF THE INVENTION

1. Field of the Invention

This invention relates to connectors for office panels. In one of its aspects, the invention relates to a connector system for office panels in which wire management channels are formed in the upper portions of the panel. In another of its aspects, the invention relates to a connector system for office panels wherein panels of different height can be connected together with or without a spacer between the panels. In still another of its aspects, the invention relates to a connector system for office panels wherein many different configurations can be accomplished with relatively few parts.

2. State of the Prior Art

Office panels in open plan configuration are in common use. These panels are typically connected together through rigid connectors. Wedge and draw block connectors used in systems sold by Herman Miller, Inc. are disclosed and claimed in Propst et al. U.S. Pat. No. 3,517,467, issued June 17, 1968. Ninety degree configurations, and three- and four-panel joints are made with rectangular spacer tubes in the Propst et al. system. A change of height between panels is accomplished also with the spacer tube. In such cases of change of height, special blocks are mounted to the spacer tube at the height of the shorter panel. Different tubes are required for each different configuration of panel connections. Whereas this system is effective, it requires a multitude of parts.

There are many other types of connector systems, some of which use a modified wedge and draw block systems. References which disclose other connector systems include:

U.S. Reissue Pat. No. 32,890, issued Mar. 21, 1989

Mollenkopf et al. U.S. Pat. No. 4,375,010, issued Feb. 2, 1983

Wilson et al. U.S. Pat. No. 4,716,698, issued Jan. 5, 1988

Morrison et al. U.S. Pat. No. 4,567,698, issued Feb. 4, 1986

Person U.S. Pat. No. 4,232,183, issued Nov. 4, 1980

Hage et al. U.S. Pat. No. 4,104,838, issued Aug. 8, 1978.

Those references which show a change-of-height connector are:

Boulva U.S. Pat. No. 4,047,342, issued Sept. 13, 1977

Temple et al. U.S. Pat. No. 4,120,124, issued Oct. 17, 1978

Bleeker et al. U.S. Pat. No. 3,809,142, issued May 7, 1974

Hasbrouck et al. U.S. Pat. No. 4,448,003, issued May 15, 1984.

The use of cosmetic covers on connectors is disclosed in:

Ravotti et al. U.S. Pat. No. 4,719,731, issued Jan. 19, 1988

Johnson et al. U.S. Pat. No. 2,766,855, issued Oct. 16, 1956

Raith et al. U.S. Pat. No. 4,438,614, issued Mar. 27, 1984

Heller U.S. Pat. No. 4,126,978, issued Nov. 28, 1978

Morrison U.S. Pat. No. 4,567,698 issued Feb. 4, 1986

LaGue U.S. Pat. No. 3,593,475, issued July 20, 1971

Watkins U.S. Pat. No. 3,327,440, issued June 27, 1967.

SUMMARY OF THE INVENTION

According to the invention, a panel connector for office partition panels has rectangular panel frames at the edges thereof and a wire management channel formed in an upper portion of the panel. A connector assembly rigidly connects the rectangular panel frames together at the side edges thereof, the connector assembly including upper and lower wedge blocks on the panel edges and draw blocks adapted to grip the wedge blocks and the draw blocks of adjacent frames together. In one aspect of the invention, the panels have a wire management channel formed in an upper portion thereof and at least one upper wedge block has a U-shaped configuration with a wedge surface formed at a bight portion of the U, the legs of the wedge block extend up along the upper side edges of the panel and in registry with the wire management channel thereof.

In one embodiment, the faces are mounted on the panels to cover opposite sides of the frame with the faces extending laterally beyond the side edges of the frame to form a vertical channel therewith. The legs of the upper wedge block extend along the inside the side faces near the corner of the side faces for reinforcement thereof. Preferably, the legs of the one upper wedge block have indented portions which form an indented channel with the side faces for receiving fabric. The panel face is preferably covered with a fabric which is wrapped around the edges of the faces and a portion of the fabric is tucked into the indented channel.

In a preferred embodiment of the invention, the draw block assemblies comprise an upper draw block with an upper wedge-shaped surface, a lower draw block with a lower wedge-shaped surface and a draw tube between the upper and lower blocks. An adjustable coupler draws the upper and lower draw blocks together to bring corresponding wedge blocks of adjacent panels into tight and rigid relationship with the connector assembly. The draw tube can form a spacer or corner between adjacent panels. The draw tube preferably is rectangular in cross sectional configuration. In this configuration of the connector, the lower draw block is attached to the draw tube and the upper draw block is adjustably connected to an upper portion of the draw tube to draw the upper and lower blocks together as the upper draw block is adjusted toward the lower draw block. In a preferred embodiment, a threaded fastener attaches the upper draw block to the draw tube. With the invention, the adjacent panel can be attached at 90° to each other through the connector assembly, the adjacent panels can be attached in line with each other through the connector assembly or the adjacent panels can be connected in three or four panel configurations with two of the panels connected at 90° to one another and at least two of the panels connected in line with each other.

In accordance with a preferred embodiment of the invention, a filler extrusion is mounted to side portions of the draw tube between the upper and lower wedge blocks to fill in the space therebetween. Preferably, the filler extrusion is W-shaped in cross section. Further, a cover member is removably mounted to the draw tube side portions without the filler extrusion to cover the draw tube for cosmetic purposes. The cover members have an outer surface flush with an outer surface of adjacent panels. The cover members can be flat or L-shaped in cross section, the latter of which configuration is used to cover two sides of the draw tube. The cover members are removably mounted to side portions of the draw tube, preferably through inner fitting flanges on the cover member and the filler extrusion.

Further according to the invention, a base cover connector comprises a base plate, a base cover and a post. The base plate is mounted to a lower portion of the draw tube, the post is mounted to the base plate and extends downwardly therefrom and the base cover is mounted to the base plate and to the post, extending downwardly from a lower portion of the draw tube.

Also, according to the invention, a panel connector for adjacent panels of different height has a height change assembly attached to the taller panel at a mid-portion thereof in registry With at least one upper wedge block. The change-of-height assembly comprises a clip having a pair of downwardly extending hanging flanges, the frame has a hanger attached to side edges thereof, the hanger having flange receiving openings that receive hanging flanges and the clip is mounted to the flange through the hanging flanges which are mounted in the hanger frame receiving openings. The clip is preferably U-shaped in configuration and is mounted to a block. The block has a lower wedge surface adapted to complement and cooperate with an upper wedge surface on an upper wedge block on an adjacent structure to draw adjacent panels together as the height change assembly and the upper wedge blocks are adjusted vertically toward each other. Preferably, the block has a vertical opening therethrough and a change of height assembly further comprises a draw rod which extends through the opening in the block. The draw rod has a threaded end which is threaded into the lower draw block beneath the change of height assembly.

In accordance with one embodiment of the invention, a top cap is snapped onto the top of a connector assembly through a wedge block which is secured to the top of the tube.

The invention provides a system for connecting together panels rigidly through a wedge block and draw block connector assemblies wherein many of the same parts can be used for many different configurations. Panel-to-panel connections can be made with a simple change of height assembly without the need for a spacer, although a spacer can be provided when desirable, for example, when a corner is used. Further, the same connector tube can be used regardless of whether the connection is an in-line spacer, a right angle connection, a three-way connection or a four-way connection. The use of the removable filler extrusion, corner pieces, and cosmetic covers adapts a single, relatively inexpensive structural rectangular tube, to many different configurations. On the other hand, the filler extrusion, corner connector and cosmetic covers can be made inexpensively, but attractively, from extruded plastic.

BRIEF DESCRIPTION OF THE DRAWINGS

The invention will now be described with reference to the accompanying drawings in which.

DESCRIPTION OF THE PREFERRED EMBODIMENT

Figure 1A:
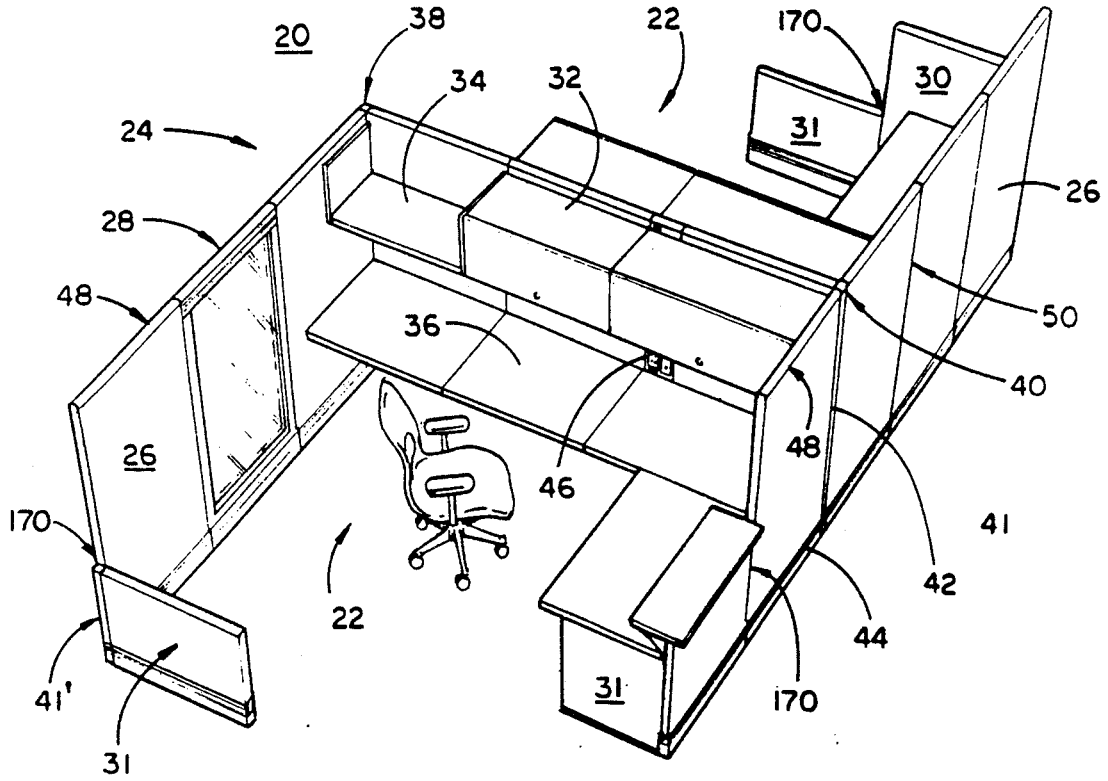
FIGS. 1A and 1B are perspective views of an open plan office furniture system incorporating panel connector systems to the invention.
Figure 1B:
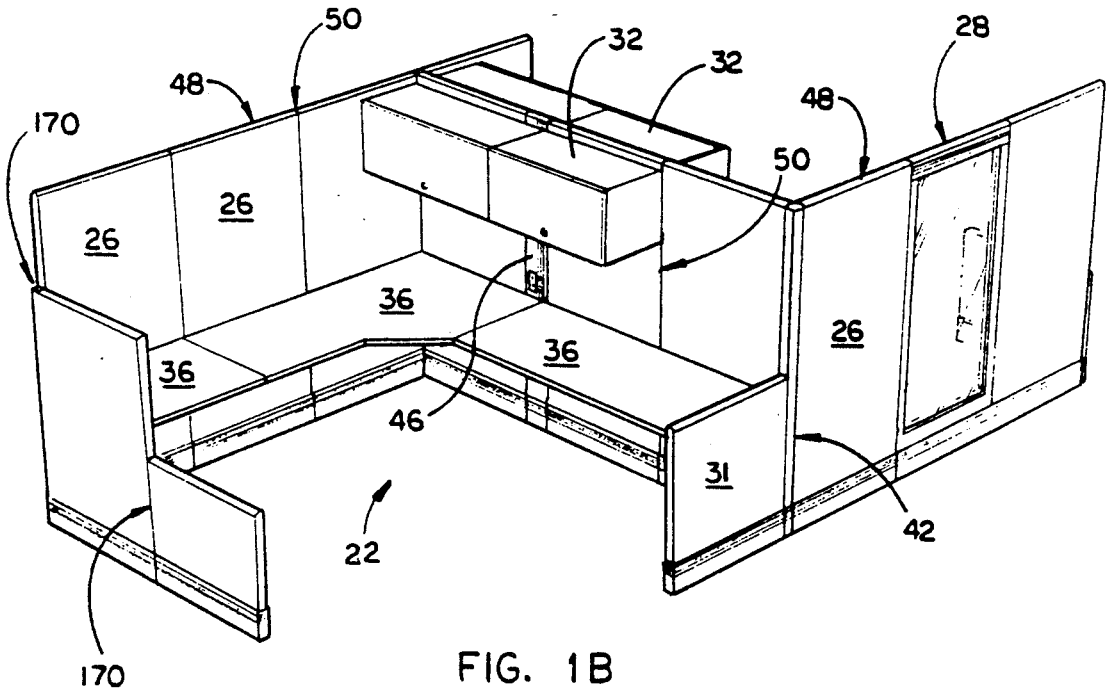

Referring now to the drawings, and to FIG. 1 in particular, there is shown an open plan office furniture system 20 which is formed by multiple work stations 22. The work stations 22 are comprised of office walls 24, which are formed by connecting together at side edges thereof, in various combinations, full sized panels 26, glazed panels 28, mid height panels 30, and waist height panels 31. Cabinets 32, shelves 34, and work surfaces 36 are attached to the full sized panels 26, mid size panels 30, and waist height panels 31 in cantilevered fashion. The different panels can be connected in a 90° two-way corner 38, a three-way corner 40, and a four-way corner (not shown), by means of a tube connecting system 41 which includes a connecting post 42. Electricity is provided to the panels by a lower horizontal electrical raceway 44, a vertical electrical channel 46, and an upper wire management channel 48.

The panels 26 are connected to each other and to the glazed panels 28 through a linear wall panel connecting system 50. The full sized panels 26 are connected to the mid height panels 30 and to the waist height panels 31, and the mid height panels 30 are connected a waist height panels 31 through a change of height connector system 170. Likewise, the change of height connector system 170 connects a full size panel 26 to a waist height tube connector system 41'.

Figure 2:
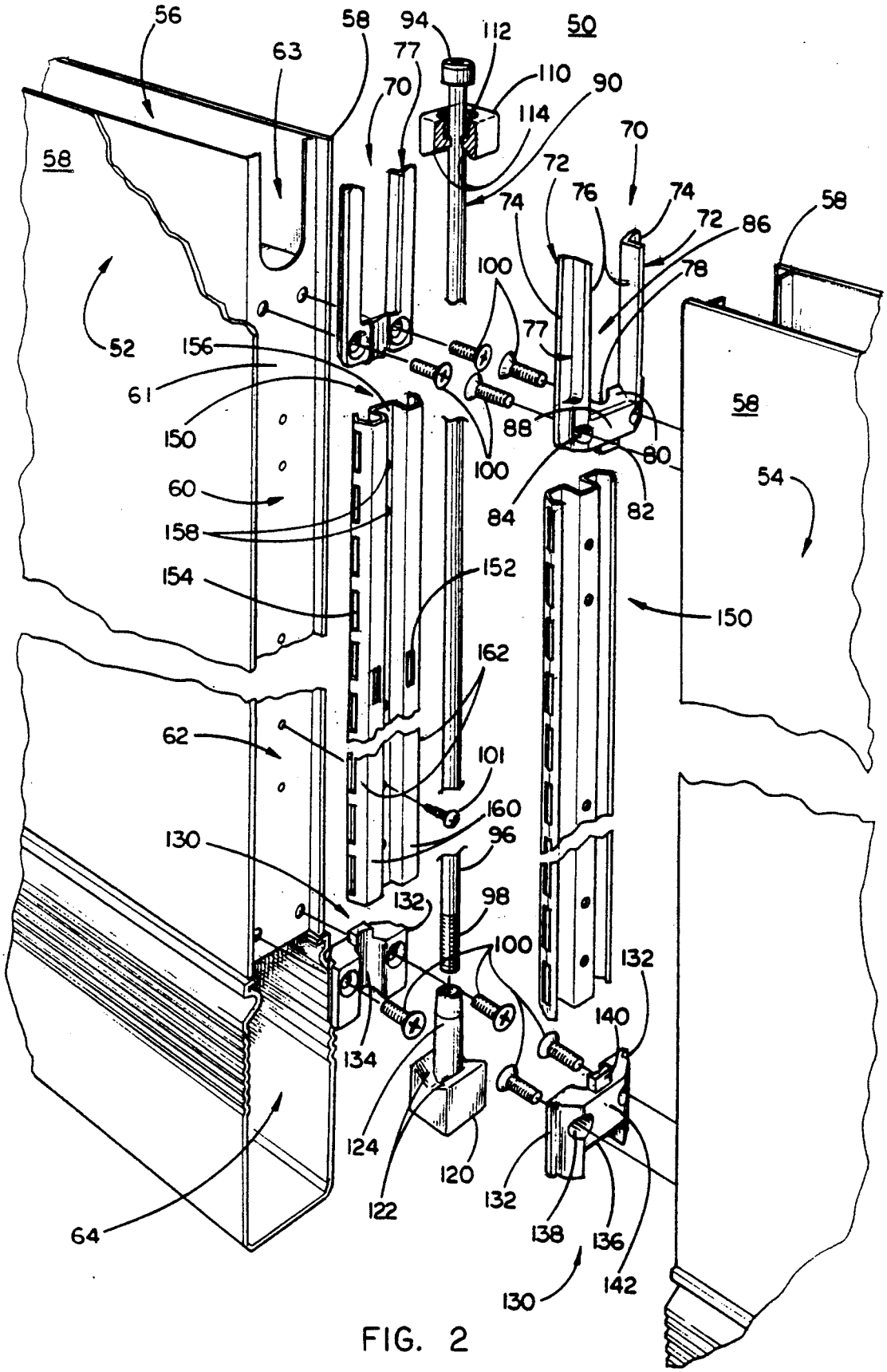
FIG. 2 is an exploded view of a panel connector system according to the invention.

Referring now to FIG. 2, the linear wall panel connection system 50 for two panels of equal height is comprised of: upper wedge blocks 70, lower wedge blocks 130, upper draw block 110, lower draw block 120, draw rod 90, hanger frame 150, and wall panels 52, 54. The upper draw block 110, lower draw block 120 and draw rod 90 comprise a draw block assembly.

The upper wedge block 70 has a base 88 from which extend channel legs 72, a wedge surface 80, and a shaft guide extension 82. The channel legs 72 are formed by stop flanges 74 and channel flanges 76. A U-shaped channel 86 is formed by a base 88 and the channel flanges 76. Screw holes 84 pass through the base 88. A semi-annular shaft guide 78 is formed in the wedge surface 80, base 88, and shaft guide extension 82.

The lower wedge block 130 has a base 142 with stop flanges 132, wedge surface 136, and shaft guide extension 140 extending therefrom. Through hole 138 passes through the base 142. A half-cylindrical shaft guide 134 is formed in the wedge surface 136, the base 142, and the rod guide extension 140.

The upper draw block 110 has two draw surfaces 114 and an opening 112. The draw surfaces 114 are complementary to the wedge surface 80 of the upper wedge block 70. The lower draw block 120 is similar to the upper draw block 110 in that they both have draw surfaces 122 and 114. However, the lower draw block has an annular receiver 124 with a threaded bore instead of an opening 112. The draw rod 90 is comprised of a shaft 96 which is threaded at the lower end 98, and has a hex wrench head 94 at the upper end.

The frame hanger 150 is W-shaped in cross section and has a channel 156 formed between the two front surfaces 160. End slots 152 are spaced along the front surfaces 160. Side flanges 162 extend outwardly and backwardly from the front surfaces 160. Accessory slots 154 are spaced along the side flanges 162. Screw holes 158 are spaced along the back of the channel 156.

The panels 52, 54 are comprised of a frame 60 at the edges of the panel, rectangular side faces 58, wire management channel 56, and a lower electrical raceway 64. The panel side faces 58 extend beyond the panel frame 60 to form an end channel 62. The upper wedge block 70, the frame hanger 150, and the lower wedge block 130, are inserted into the end channel 62 and fastened by screws 100. The frame 60 is formed from vertical stiles 61 and horizontal connectors 63, the latter of which forms the wire management channel 56.

Figure 3:
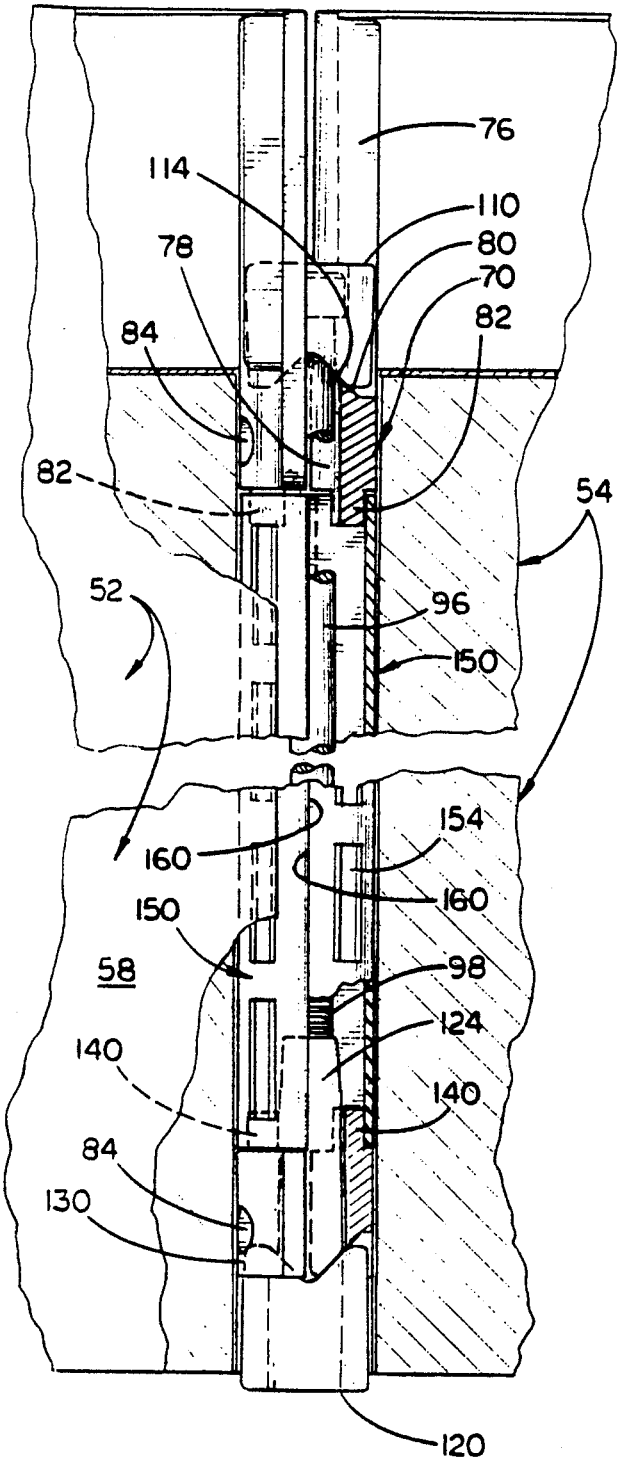
FIG. 3 is a front elevation view of the panel connector system shown in FIG. 2, partially broken away.
Figure 4:
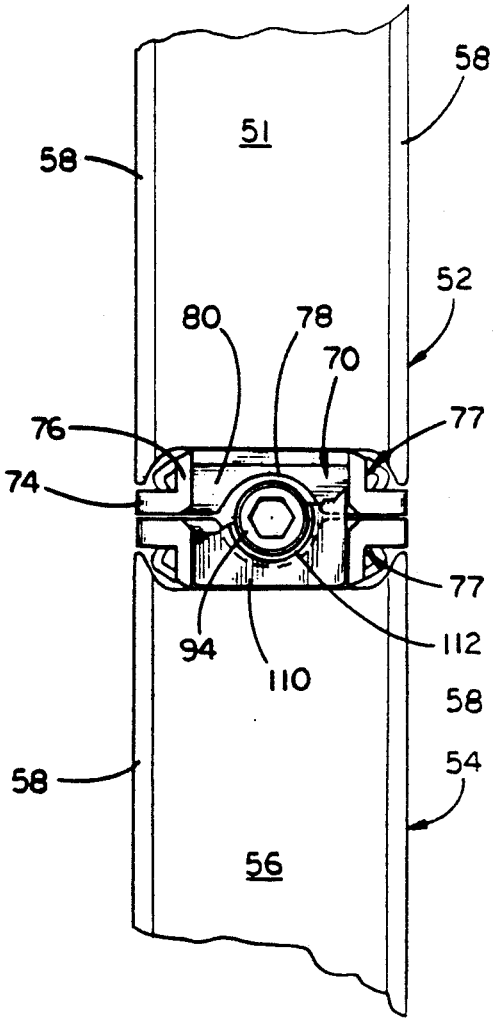
FIG. 4 is a plan view of the panel connector system shown in FIGS. 2 and 3, partially broken away.

FIGS. 3 and 4 disclose how the panels 52, 54 are connected by the panel connecting system 50. An upper wedge block 70 is pressed into the end channel 62 of the panels 52 and 54. The stop flanges 74 keep the upper wedge block 70 parallel to the panel side faces 58. Further the flanges 74 and 76 form with the side faces an elongated fabric channel 77 into which fabric which covers the faces 58 can be tucked and accumulated. The corners of the panels are a location where fabric is gathered. The channel 77 provides an area into which the gathered fabric can be tucked, accumulated and held. The channel flanges 76 create an extension of the wire management channel 56. Screws 100 pass through the screw holes 84 and fasten the upper wedge block 70 to the frame 60 of panels 52 and 54.

The lower wedge block 130 is mounted in a manner similar to the upper wedge block 70. A lower wedge block 130 is pressed into the end channel 62 of the panels 52 and 54. The stop flanges 132 hold the lower wedge block parallel to the panel sides 58. Screws 100 pass through the screw holes 138 and fasten the lower wedge block 130 to the frame 60 of panels 52 and 54.

The frame hanger 150 is placed into the end channel 62 and fastened to the frame 60 by screws 101. The faces of stop flanges 74, 132, for both the upper and lower wedge blocks 70, 130, lie in the same plane as the faces 160 of the frame hanger 150.

The panels 52, 54 are then brought together. The faces of the stop flanges 74, 132 and the hanger frame 160 lie flush with the respective faces of the other panel 54. A shaft channel 102 is formed interior to the two panels by the semi-annular shaft guides 78, 134 and the channel 156 and their corresponding parts on the other panel 54.

The shaft 96 of the draw rod 90 is inserted through the opening 112 of the upper draw block 110. The shaft 96 is then inserted into the shaft channel 102. The threaded annular receiver 124 of the lower draw block 130 is inserted from the bottom up through the half-cylindrical openings 134 where it makes contact with the threaded lower end 98 of the shaft 96. The hex wrench head 94 is turned, screwing the lower threaded end 98 into the threaded bore of the threaded annular receiver 124. This action draws the draw surfaces 114, 122 of the upper and lower draw blocks 110, 120 into contact with the complementary wedge surfaces 78, 136. As the draw rod 90 is fully tightened, the draw surfaces 114, 122 force the panels 52, 54 tightly together under compression at the side edges thereof.

After the panels 52, 54 are drawn together, the alignment flanges 76 form a channel 86 which extends the wire management channel 56 between the panels 52, 54. This channel extension hides from view the wires passing through the wire management channel 56.

Figure 5:
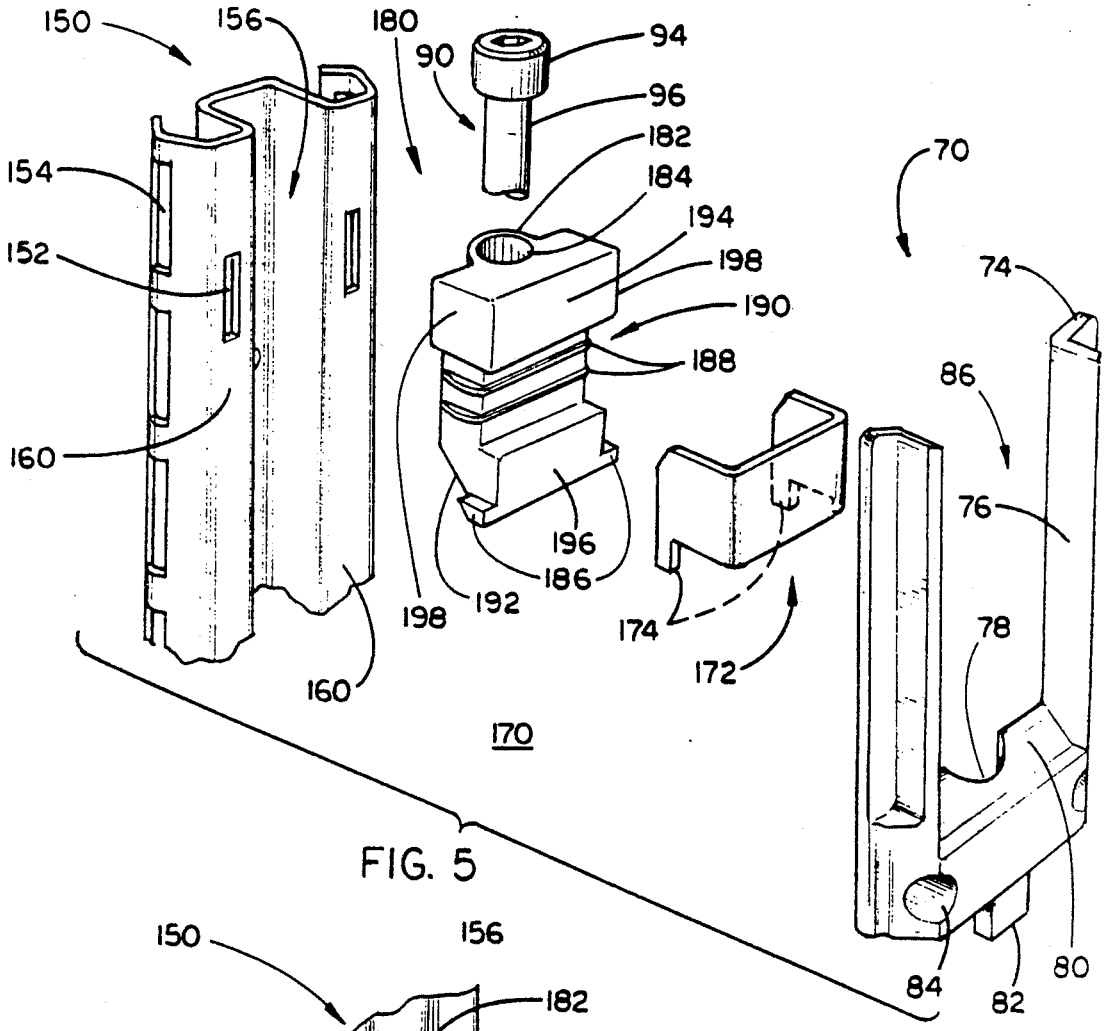
FIG. 5 is an exploded view of a change of height panel connector according to the invention.
Figure 6:
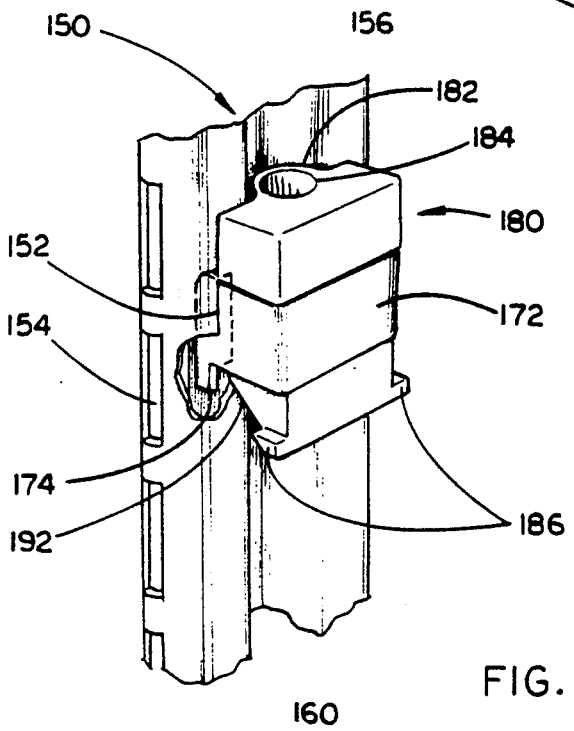
FIG. 6 is a perspective view of the change of height connector shown in FIG. 5 fastened to a panel and partially broken away.

FIGS. 5 and 6 illustrate the change of height connector system 170. This system is comprised of a modified draw block 180, clip 172, frame hanger 150, and an upper wedge block 70.

The modified draw block 180 has an arcuate extension 182 which forms the outer wall of the annular opening 184. The upper base 194 and the lower base 196 form a receiving channel 190 into which the ribs 188 extend. The draw surface 192 forms the back side of the lower base 196. The positioning flanges 186 and the upper base extensions 198 position the modified draw block 180. The U-shaped fastening clip 172 has two hanging flanges 174.

The change of height connector system 170 also uses the frame hanger 150, the draw rod 90, upper wedge block 70, and lower Wedge block 130 as previously described in the linear, equal height panel connector.

Figure 7:
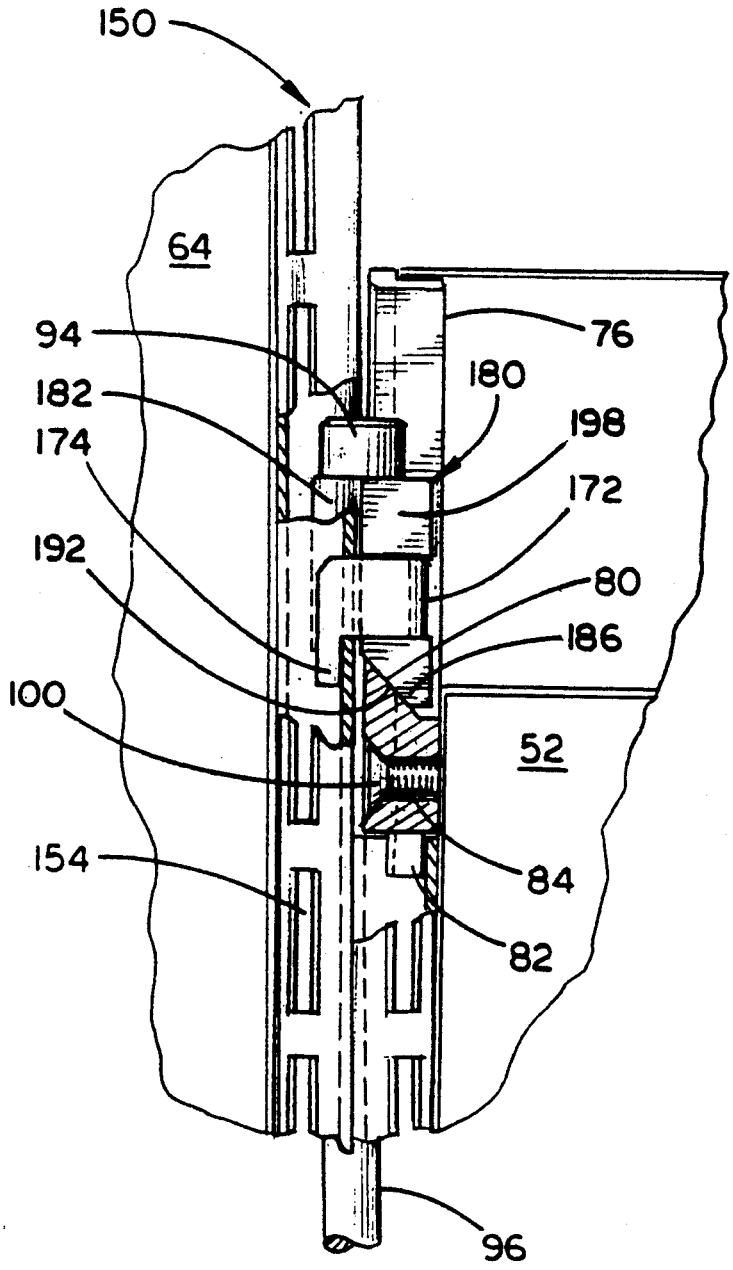
FIG. 7 is a front elevation view in partial section of the change of height connector shown in FIGS. 5 and 6.

FIGS. 6 and 7 illustrate the operation of the change of height connector. The fastening clip 172 is pressed over the ribs 188 and into the receiving channel 190 of the modified draw block 180. The arcuate extension 182 is placed into the channel 156 of the frame hanger 150. The hanging flanges 174 are then inserted into the end slots 152 on the frame hanger faces 160. This connection fastens the change of height connector 170 to the frame hanger 150 of the taller panel 64.

The two panels 52, 64 are brought together and the change of height connector 170 is guided into the channel 86 of the upper wedge block 70, which is affixed to the shorter panel 52. The positioning flanges 186 and the upper base sides 198 keep the change of height connector 170 within the channel 86 of the upper wedge block 70. The draw surface 192 contacts the complementary wedge surface 80 of the upper wedge block 70.

The shaft 96 of the draw rod 90 is inserted through the annular opening 184 of the modified draw block 180. The threaded lower end 98 of the draw rod 90 is screwed into the threaded annular receiver 124 of the lower draw block 120 as previously described. As the draw rod is tightened, the lower and upper draw surfaces 192, 122 draw the panels 52, 64 together under compression.

Figure 8:
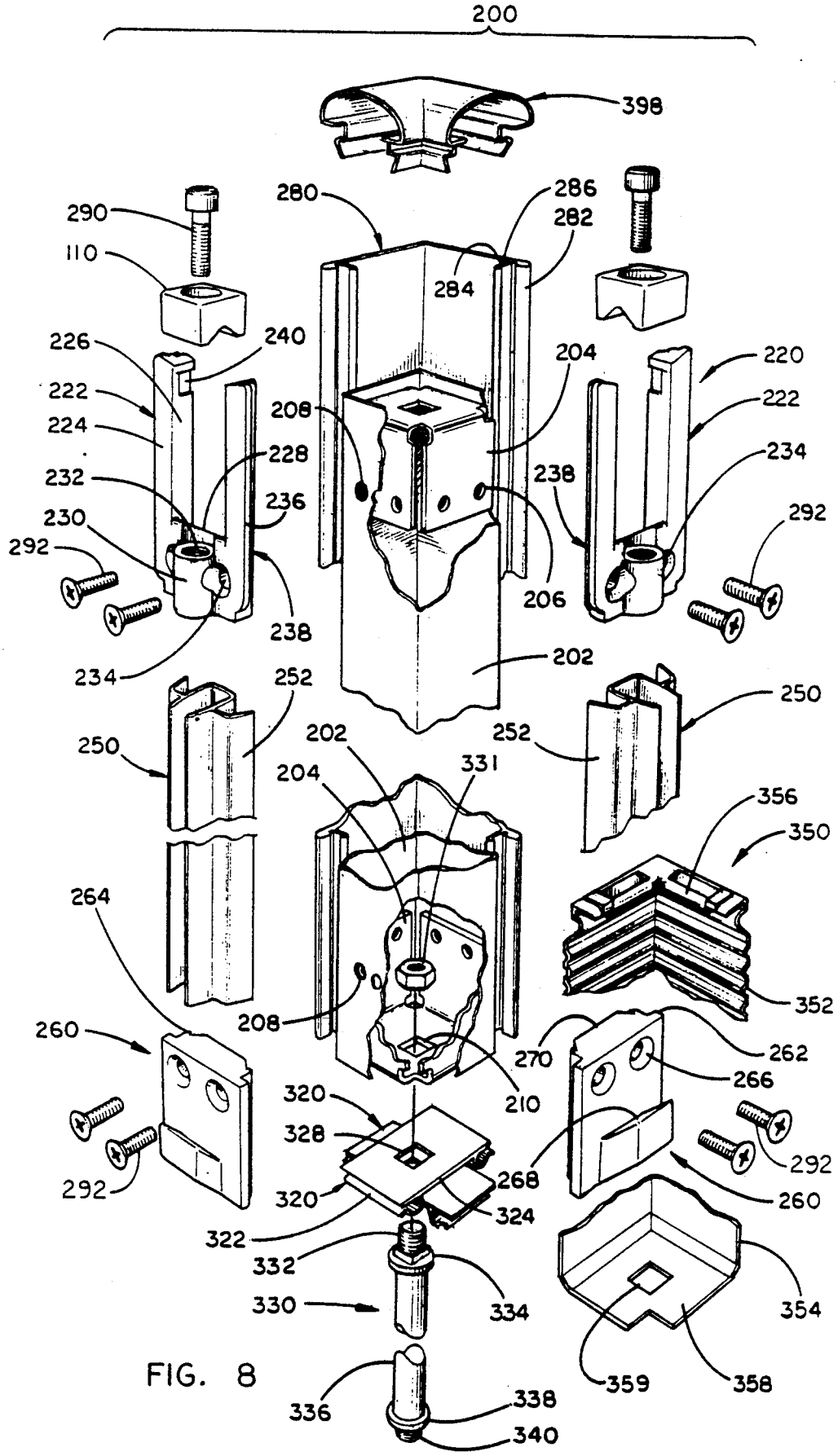
FIG. 8 is an exploded view of a tube connector system according to the invention, with portions of the tube connector system being partially broken away.

FIG. 8 illustrates a panel spacer or corner connecting system 200 by which two, three, or four panels can be connected together at various right angles or in line with each other. The spacer connecting system 200 is comprised of: connecting tube 202, tube bracket 204, threaded upper wedge block 220, modified lower draw block 260, filler extrusion 250, upper draw block 110, fastening bolt 290, cosmetic cover 280, receiver base connectors 320, base cover connector 330, and base cover 350.

The connecting tube 202 is an elongated square tube with screw holes 208. The tube bracket 204 is internal to the connecting tube 202 and has screw holes 206 and post opening 210.

The threaded upper wedge block 220 is similar to the upper wedge block 70 in that it is comprised of a base 238, a channel wing 222, a stop flange 224, an channel flange 226, a wedge surface 228, and screw holes 234. However, the threaded upper wedge block 220 has an arcuate extension 230 which forms a threaded receiving opening 232 and a receiving flange 236 which extends from the base 238.

The modified lower draw block 260 is similar to the lower wedge block 130 in that it is comprised of a base 270, stop flange 262, and screw holes 266. However, it has a wedge surface 268 which extends upwardly and outwardly from the base 270, and receiving flanges 264 and thus functions as a draw block. Screw holes 266 pass through the base 270. The filler extrusion 250 is generally W-shaped and has resilient spring like flanges 252 at both edges.

The cosmetic cover 280 is comprised of a main body 286 which extends the height of the panel, an extension flange 282, and a hook flange 284. The cosmetic cover 280 is used for a two-way 90° panel connection. The receiver base connectors 320 have a main base 324 from which extend the C-shaped snap flanges 322. The C-shaped snap flanges extend the width of the main base 324. Two bases 324 are used at right angles to one another for a right angle connection. The post opening 328 is square and extends through the main base 324.

The base cover connector 330 is comprised of an internally threaded upper shaft 332 which is separated from the central shaft 336 by the upper collar 334. The central shaft 336 is separated from the internally threaded lower shaft 340 by the lower collar 338. A hex nut 331 is threaded onto the central shaft 336 to retain the shaft 336 on the connecting tube 202.

The base cover 350 has two sections, the upper decorative section 352 and the lower section 354. At the top of the upper section 352, an arcuate flange 356 extends outward. The bottom 358 of the base cover 350 has a square-shaped post opening 359.

Figure 9:
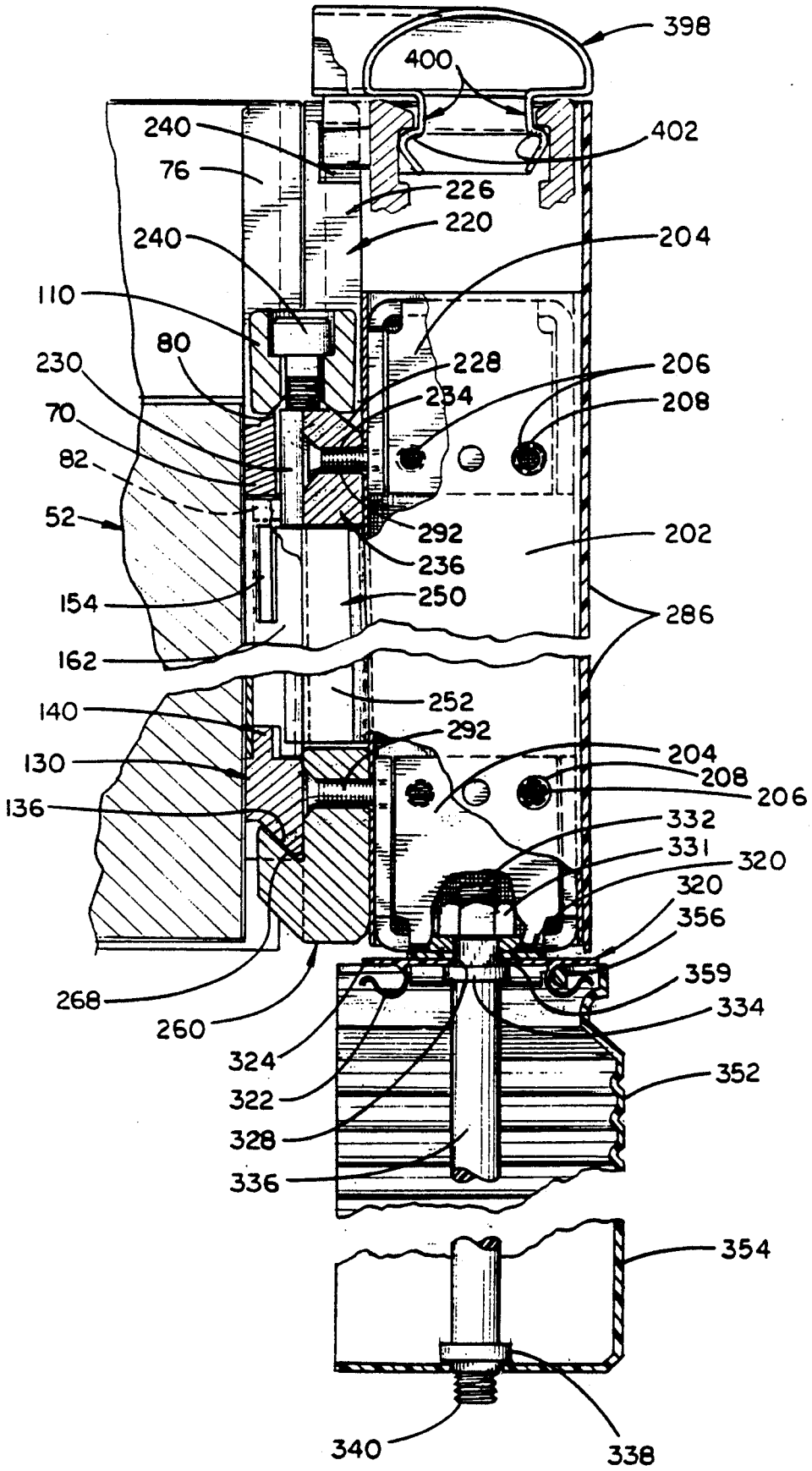
FIG. 9 is a front elevation view in section of the tube connector system shown in FIG. 8.

FIG. 9 illustrates the assembly of the panel spacer connecting system 200. The tube bracket 204 is placed inside the connecting tube 202 with the bracket screw holes 206 aligned with the tube screw holes 208. The upper wedge blocks 220 are then screwed into the tube brackets through the connecting tube screw holes 208 by screws 292. The same method is used to connect the modified lower draw block 260 to the connecting tube 202. The filler extrusion 250 is then adhered to the connecting tube 202 between the threaded upper wedge block 220 and the modified lower wedge block 260 on each side of the connecting tube 202 where a panel connection is to be made.

The connecting tube 202 is then connected to a wall panel 52. The draw surface 268 of the modified lower draw block 260 of the connecting tube 202 is hooked under the lower wedge block 130 of panel 52, bringing the draw surface 268 into contact with the complementary wedge surface 136 of the lower wedge block 130. The top of the connecting tube 202 is then abutted to the top of the panel 52. An upper draw block 110 is placed onto the wedge surfaces 228 and 80 of the threaded upper wedge block 220 and the upper wedge block 70. The fastening bolt 290 is inserted into the threaded opening 232 of the threaded upper wedge block after passing through the annular opening 112 of the upper draw block 70. The fastening bolt 240 is screwed into the threaded opening 232. As the fastening bolt 290 is tightened, the wedge surface 268 of the modified lower draw block 260 is drawn into contact with the wedge surface 136 of the lower wedge block 130. Similarly, the draw surfaces 114 of the upper draw block 110 are drawn onto the complementary wedge surfaces 80, 228 of the upper wedge block 70 and the threaded upper wedge block 220, respectively, connecting the connecting tube 202 to the panel 52. This process will be repeated for each panel that is connected by the connecting tube system 200.

The threaded upper shaft 332 passes through the post opening 328 of the receiver base connector 320 and into the post opening 210 of the tube bracket 204. The lower shaft 340 of the base cover connector 330 is placed into the post opening 359 of the bottom 358 of the base cover 350. The arcuate flange 356 of the base cover 350 is then pressed into the C-shaped snap flange 322, thus fastening the base cover 350 to the connecting tube 202. A top cap 398 is removably mounted to the top of cosmetic cover 280 through retaining flanges 400 which have indented portions 402. The indented portions 402 are releasably received in the receiving grooves 240 of the upper wedge block 220.

Figure 10:
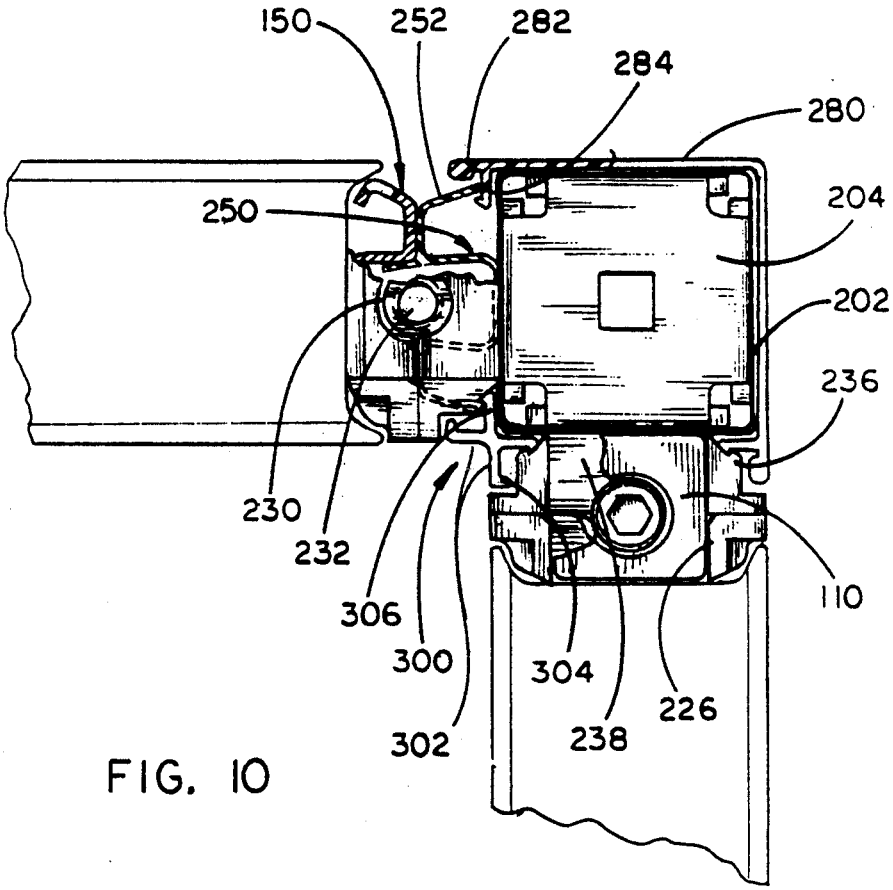
FIG. 10 is a top view of a two-way 90° panel connection utilizing .the tube connector system shown in FIGS. 8 and 9, and partially broken away.

FIGS. 9 and 10 illustrate a two-way 90° connection 38. The cosmetic cover 280 is snapped into place by the hook flanges 284. Each hook flange 284 snaps behind the resilient spring-like flange 252 of the filler extrusion 250 and the receiving flange 236 extending from the bases 236 of the threaded upper wedge block 220. The same connection method is used at the bottom of the panel and tube where the hook flange 284 snaps into the receiving flange 264 of the lower modified draw block 260. The extension flange 282 partially covers the threaded upper wedge block 220, frame hanger 150, and modified lower wedge block 260.

The inside corner cosmetic cover 300 is comprised of two hook flanges 306, two faces 302, and two extension flanges 304. The interior corner cosmetic cover 300 is fastened to the connecting post 202 in the same manner as the two-way 90° cosmetic cover 280. The hook flanges 306 of the inside cosmetic cover 300 snap behind the resilient spring-like flange 252 of the filler extrusion 250 and into the receiving flanges 236, 264 of the threaded upper wedge block 220 and the modified lower draw block 260. The faces 302 extend the height of the panel 52.

Figure 11:
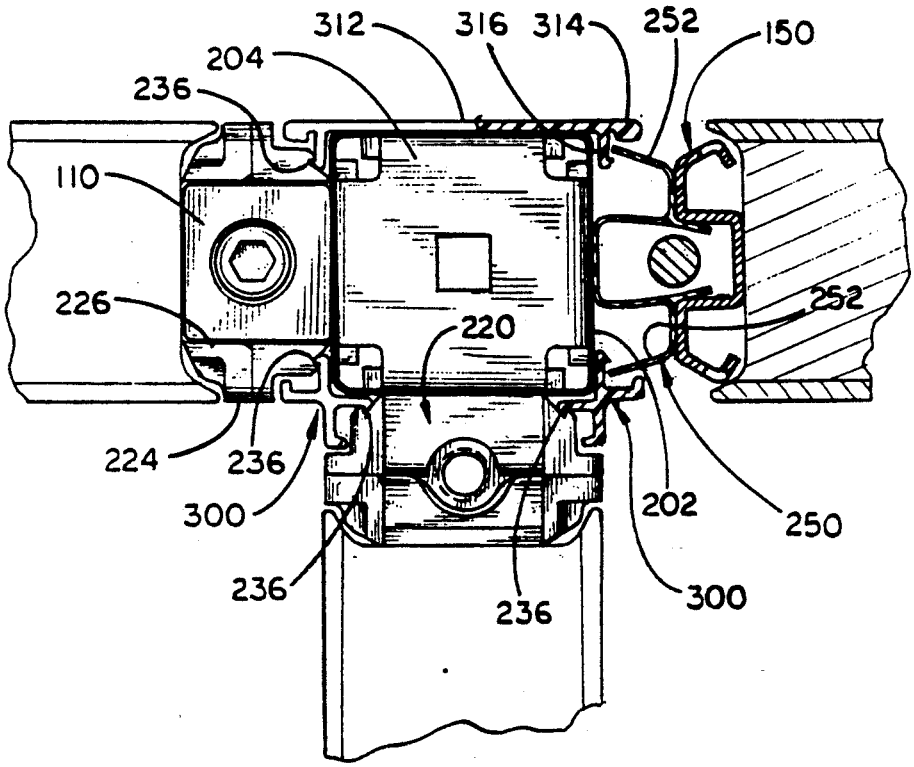
FIG. 11 is a top view, partially in section, of a three-way 180° panel connection utilizing the tube connector system illustrated in FIGS. 8 and 9.

FIG. 11 illustrates a three-way connection in which the connection at the right is shown in section beneath the wedge blocks 70 and 220. The 180° cosmetic cover 312 is comprised of an extension flange 314 and a hook flange 316. The hook flange 316 snaps under and behind the resilient spring-like flange 252 of the filler extrusion 250 and into the receiving flanges 238, 264 of the threaded upper draw block 220 and the modified lower draw block 260. An inside corner cosmetic cover 300 is placed where needed as previously described.

A fourth panel could easily be added by removing the 180° cosmetic cover 230 and fastening a threaded upper wedge block 220, filler extrusion 250, and a modified lower draw block 260 to the connecting post in its place. Then the fourth panel could be mounted to the connecting post as previously described.

As can be seen from the foregoing, the invention provides a system for rigidly connecting together adjacent panels through a wedge block and draw block type of connector systems. With this same connector system and the addition of a single rectangular tube with a selection of cosmetic covers, the panels can be connected together with a spacer in line with each other, at 90° angles to one another or any combination thereof for two, three and four panel joints. Further, the connector system provides for a simple way of connecting together adjacent panels of unequal height with or without a spacer. The system also makes retrofit in the field extremely simple by the use of a few interchangeable parts.

Reasonable variation and modification are possible within the scope of the foregoing disclosure and drawings without the departing from the spirit of the invention which is defined in the appended claims.

The embodiments of the invention for which an exclusive property or privilege is claimed are defined as follows:

1. A panel connector for office partition panels having rectangular panel frames at the edges thereof and a wire management channel formed in an upper portion of the panel, a connector assembly for rigidly connecting the rectangular panel frames together at the side edges thereof, said connector assembly including upper and lower wedge blocks on the panel side edges and draw block assemblies adapted to grip the wedge blocks and draw the wedge blocks of adjacent frames together; the improvement which comprises:

at least one upper wedge block having a U-shaped configuration with a wedge surface formed at a bight portion of the U, the legs of the upper wedge block extending up along upper side edges of a panel in register with the wire management channel thereof.

2. A panel connector according to claim 1 wherein the panels have mounted on the frames faces which cover opposite sides of the frames and extend laterally beyond the side edges of the frames to form a vertical channel therewith, and the legs extend along the inside of the side faces near the corner of the side faces for reinforcement.

3. A panel connector according to claim 2 wherein the legs of the one upper wedge block have indented portions which form an indented channel with the side faces for receiving fabric; and the panel face is covered with a fabric which is wrapped around the edges of the faces and a portion thereof is tucked into the indented channel.

4. A panel connector according to claim 3 wherein the draw block assemblies comprise:

an upper draw block with upper wedge shaped surface;

a lower draw block with a lower wedge shaped surface;

a draw tube between the upper and lower draw blocks; and an adjustable coupler to draw the upper and lower draw blocks together to bring corresponding wedge blocks on adjacent panels into tight and rigid relationship with the connector assembly.

5. A panel connector according to claim 4 wherein the draw tube forms a spacer or corner between adjacent panels.

6. A panel connector according to claim 5 wherein the lower draw block is attached to the draw tube and the upper draw block is adjustably connected to an upper portion of the draw tube to draw upper and lower draw blocks together as the draw block is adjusted toward the lower draw block.

7. A panel connector according to claim 6 wherein a threaded fastener attaches the upper draw block to the draw tube.

8. A panel connector according to claim 5 wherein adjacent panels are attached at 90° to each other through the connector assembly.

9. A panel connector according to claim 5 wherein adjacent panels are attached in line with each other through said connector assembly.

10. A panel connector according to claim 5 wherein at least three panels are connected together at edges through a connector assembly; two of said panels are connected at 90° to one another and two of said panels are connected in line with each other.

11. A panel connector according to claim 5 wherein a filler extrusion is mounted to side portions of the draw tube between an upper wedge block and the lower draw block.

12. A panel connector according to claim 11 wherein the filler extrusion is W-shaped in cross section and fills the space between the upper wedge block and the lower draw block.

13. A panel connector according to claim 11 wherein a cover member is removably mounted to the draw tube side portions without the filler extrusion to cover the draw tube.

14. A panel connector according to claim 13 wherein the cover members have an outer surface flush with an outer surface of adjacent panels.

15. A panel connector according to claim 14 wherein the cover is L-shaped in cross section and covers two sides of a draw tube.

16. A panel connector according to claim 5 wherein a cover member is removably mounted to a side portion of a draw tube to cover the same.

17. A panel connector according to claim 5 and further comprising a base cover connector comprising a base plate, a base cover and a post, the base plate being mounted to a lower portion of the draw tube, the post mounted to the base plate and extending downwardly therefrom and the base cover extending downwardly from a lower portion of the draw tube and removably mounted to the base plate and the post.

18. A panel connector according to claim 5 wherein the draw tube is rectangular in cross section.

19. A panel connector according to claim 2 wherein the draw block assemblies comprise:

an upper draw block with a lower wedge shaped surface;

a lower draw block with an upper wedge shaped surface;

a draw tube between the upper and lower draw blocks; and an adjustable coupler to draw the upper and lower draw blocks together to bring corresponding wedge blocks on adjacent panels into tight and rigid relationship with the connector assembly.

20. A panel connector according to claim 1 wherein the draw block assemblies comprise:

an upper draw block with a lower wedge shaped surface;

a lower draw block with an upper wedge shaped surface;

a draw tube between the upper and lower draw blocks; and an adjustable coupler to draw the upper and lower draw blocks together to bring corresponding wedge blocks on adjacent panels into tight and rigid relationship with the connector assembly.

21. A panel connector according to claim 1 wherein adjacent panels are of different height and the connecting means further includes:

a height change assembly attached to a taller panel at a mid portion thereof in registry with said at least one upper wedge block.

22. A panel connector according to claim 21 where the height change assembly comprises:

a clip having a pair of downwardly extending hanging flanges;

the frame has a hanger attached to side edges thereof;

the hanger has flange receiving openings that receive hanging flanges; and the clip is mounted to the frame through the hanging flanges which are mounted in the hanger receiving openings.

23. A panel connector according to claim 22 wherein the clip is U-shaped in configuration.

24. A panel connector according to claim 22 wherein the height change assembly has a block mounted to the clip; and the block has a lower wedge surface adapted to complement and cooperate with an upper wedge surface on said at least one upper wedge block to draw adjacent panels together as the height change assembly and the upper wedge block are adjusted vertically toward each other.

25. A panel connector according to claim 24 wherein the block has a vertical opening therethrough and the change of height assembly further comprises a draw rod which extends through the opening in the block; the draw rod has a threaded end which is threaded into a lower draw block beneath the change of height assembly.

26. A panel connector according to claim 22 wherein the draw block assemblies comprise:

an upper draw block;

a lower draw block;

a draw tube between the upper and lower draw block; and an adjustable coupler to draw the upper and lower blocks together to bring corresponding wedge blocks on adjacent panels into tight and rigid relationship with the connector assembly.

27. A panel connector according to claim 26 wherein the draw tube forms a spacer or corner between adjacent panels.

28. A panel connector for office partition panels having rectangular panel frames at side edges thereof, a connector assembly for rigidly connecting the rectangular panel frames together at the side edges thereof, said connector assembly including upper and lower wedge blocks on the panel side edges and draw block assemblies adapted to grip the wedge blocks and draw the wedge blocks of adjacent frames together;

the improvement in the draw block assemblies comprising:

upper draw blocks above the wedge blocks;

lower draw block below the lower wedge blocks;

a draw tube between the two draw blocks;

the draw tube forming a spacer or corner between adjacent panels; and an adjustable coupler to draw the upper and lower draw blocks together to bring corresponding wedge blocks on adjacent panels into tight and rigid relationship with the draw block assembly.

29. A panel connector according to claim 28 wherein the draw tube has wedge blocks at an upper portion thereof adjacent to upper wedge blocks on adjacent panels and lower draw blocks at a lower portion thereof adjacent to lower wedge blocks on adjacent panels.

30. A panel connector according to claim 29 wherein one lower draw block is attached to the draw tube and one upper draw block is adjustably connected to an upper portion of the draw tube to draw the upper and lower blocks together as the upper draw block is adjusted toward the draw tube.

31. A panel connector according to claim 30 wherein a threaded fastener attaches the upper draw block to the draw tube.

32. A panel connector according to claim 28 wherein adjacent panels are attached at 90 degrees to each other through the connector assembly.

33. A panel connector according to claim 28 wherein adjacent panels are attached in line with each other through the connector assembly.

34. A panel connector according to claim 28 wherein at least three panels are connected together at edges through a connector assembly, two of said panels are connected at 90 degrees to one another and two of said panels are connected in line with each other.

35. A panel connector according to claim 28 wherein a filler extrusion is mounted to side portions of the draw tube between the upper and lower wedge blocks.

36. A panel connector according to claim 35 wherein the filler extrusion is W-shaped in cross section and fills the space between the upper and lower wedge blocks.

37. A panel connector according to claim 35 wherein a cover member is removably mounted to side portions between the filler extrusion to cover the draw tube therebetween.

38. A panel connector according to claim 37 wherein the cover member has an outer surface flush with an outer surface of an adjacent panel.

39. A panel connector according to claim 37 wherein the draw tube is rectangular in cross section, and the cover is L-shaped in cross section and covers two sides of a draw tube.

40. A panel connector according to claim 39 and further comprising a corner connector which is removably mounted to said draw tube at an inside corner between the filler extrusion on adjacent draw tube surfaces.

41. A panel connector according to claim 37 wherein said cover member comprises an elongated corner connector adapted to be removably mounted to said draw tube between filler extrusions on said draw tube at right angles with respect to each other.

42. A panel connector according to claim 37 and further comprising a cosmetic top cap mounted to the top of the draw tube to cover the same through a snap fit connection thereto.

43. A panel connector for office partitions panels having rectangular panel frames at the side edges thereof, a connector assembly for rigidly connecting the rectangular panel frames together at the side edges thereof, said connector assembly including upper and lower wedge blocks on the panel side edges and draw block assemblies adapted to grip the wedge blocks and draw the wedge blocks of adjacent frames together;

the improvement which comprises:

the adjacent panels are of different height and the connector assembly further includes a height change assembly attached to a taller panel at a mid portion thereof in register with said at least one upper wedge block, said height change assembly including a lower draw surface and an adjustable fastener, the lower draw surface is shaped to react with an upper wedge surface of an upper wedge block of the adjacent shorter panel to draw the height change assembly tightly against the upper wedge block of the adjacent shorter panel and to draw the different height panels together as the fastener is adjustably tightened.

44. A panel connector for office partition panels having rectangular panel frames at the side edges thereof, a connector assembly for rigidly connecting the rectangular panel frames together at the side edges thereof, said connector assembly including upper and lower wedge blocks on the panel side edges and draw block assemblies adapted to grip the wedge blocks and draw the wedge blocks of adjacent frames together;

the adjacent panels are of different height and the connector assembly further includes a height change assembly attached to a taller panel at a mid portion thereof in register with said at least one upper wedge block;

the improvement in the height change assembly comprising:

a clip having a pair of downwardly extending hanging flanges;

the frame has a hanger attached to side edges thereof;

flange receiving openings in the hanger to receive the hanging flanges; and the clip is mounted to the frame through the hanging flanges which are mounted in the hanger flange receiving openings in the hanger.

45. A panel connector according to claim 44 wherein the clip is U-shaped in configuration.

46. A panel connector according to claim 44 wherein the height change assembly has a block mounted to the clip; and the block has a lower wedge surface adapted to complement and cooperate with an upper wedge surface on said at least one upper wedge block to draw adjacent panels together as the height change assembly and the upper wedge block are adjusted vertically toward each other.

47. A panel connector according to claim 46 where the block has a vertical opening therethrough and the draw block assembly further comprises a draw rod which extends through the opening in the block; the draw rod has a threaded end which is threaded into a lower draw block beneath the change of height assembly.

48. A panel connector according to claim 43 wherein the draw block assemblies comprise:

an upper draw block;

a lower draw block;

a draw tube between the upper and lower draw block; and an adjustable coupler to draw the upper and lower blocks together to bring corresponding wedge blocks on adjacent panels in tight and rigid relationship with the connector assembly.

49. A panel connector according to claim 48 wherein the draw tube forms a spacer or corner between adjacent panels.

50. A panel connector according to claim 49 wherein the draw tube is rectangular in cross section.

* * * * *